US005170900A

United States Patent [19]

Manera

[11] Patent Number: 5,170,900

[45] Date of Patent: Dec. 15, 1992

[54] CHILD RESISTANT CLOSURE

[75] Inventor: David A. Manera, Vineland, N.J.

[73] Assignee: Comar, Inc., Buena, N.J.

[21] Appl. No.: 878,914

[22] Filed: May 6, 1992

[51] Int. Cl.[5] ..... B65D 55/02

[52] U.S. Cl. ..... 215/218; 215/206; 215/216; 215/219; 215/221; 215/230; 215/250

[58] Field of Search ..... 215/218, 201, 204, 206, 215/216, 219, 221, 230, 250, 330, 334

[56] References Cited

U.S. PATENT DOCUMENTS

| | | | |
|---|---|---|---|
| 2,372,482 | 3/1945 | Genei | 215/206 X |
| 2,381,207 | 8/1945 | Coleman | 215/206 |
| 2,772,803 | 12/1956 | Pasquariello . | |
| 3,073,468 | 1/1963 | Arneson | 215/230 |
| 3,138,277 | 6/1964 | Milbourne | 215/219 X |
| 3,313,441 | 4/1967 | Fadden | 215/206 |
| 3,615,036 | 10/1971 | Mross | 215/218 X |
| 3,625,387 | 12/1971 | Schaefer | 215/219 X |
| 3,830,392 | 8/1974 | Kessler et al. | 215/216 |
| 3,869,058 | 3/1975 | Bogert | 215/219 |
| 3,946,889 | 3/1976 | Gach | 215/219 |

*Primary Examiner*—Stephen P. Garbe
*Assistant Examiner*—Vanessa Caretto
*Attorney, Agent, or Firm*—Brady, O'Boyle & Gates

[57] ABSTRACT

A child resistant closure for a medicine bottle wherein an outer cap is freely rotatable on an inner cap. A latch assembly including a slidable latch member and a latch post are positioned between the top walls of the inner and outer caps. An aperture is provided in the top wall of the cap for observing the position of the post preparatory to sliding the latch member into engagement with the latch post for interconnecting the inner and outer caps for removal of the closure from the bottle. The inner cap is provided with a cam surface engageable with the slidable latch member for automatically moving the latch member out of engagement with the post during the securing of the closure to the bottle, and a tamper evident tab is removably connected to the outer cap to prevent the unauthorized manipulation of the latch member.

7 Claims, 3 Drawing Sheets

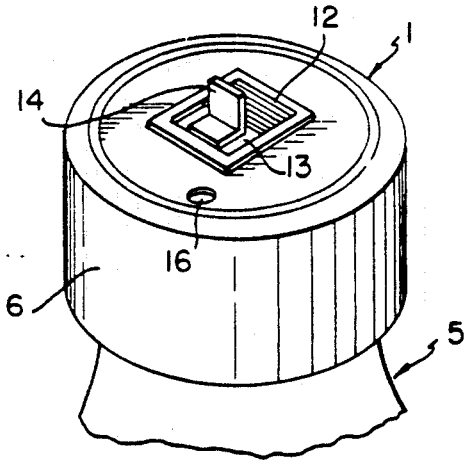
FIG. 1
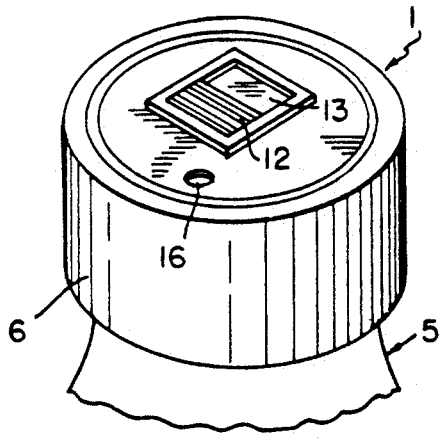
FIG. 2
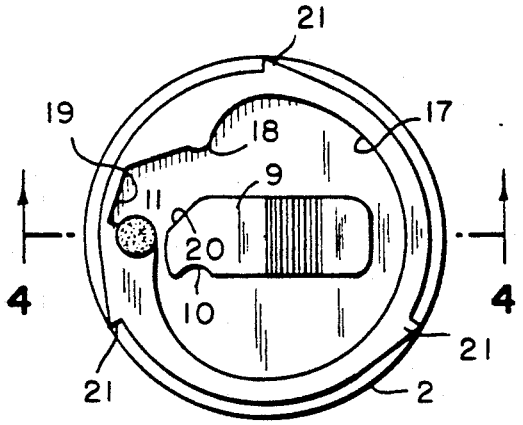
FIG. 3
FIG. 5
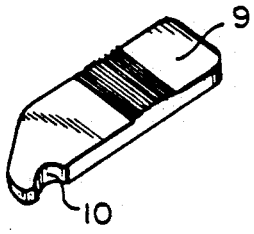
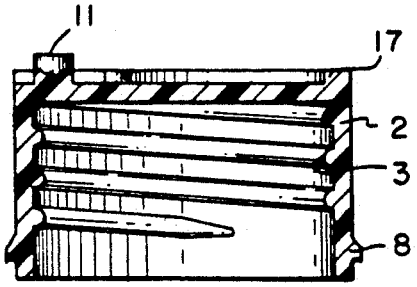
FIG. 4

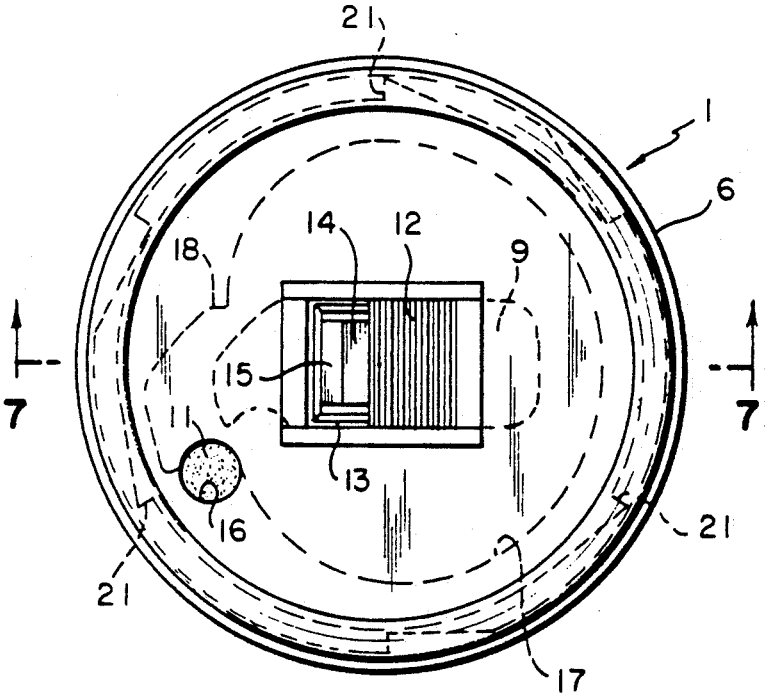
FIG. 6
FIG. 7
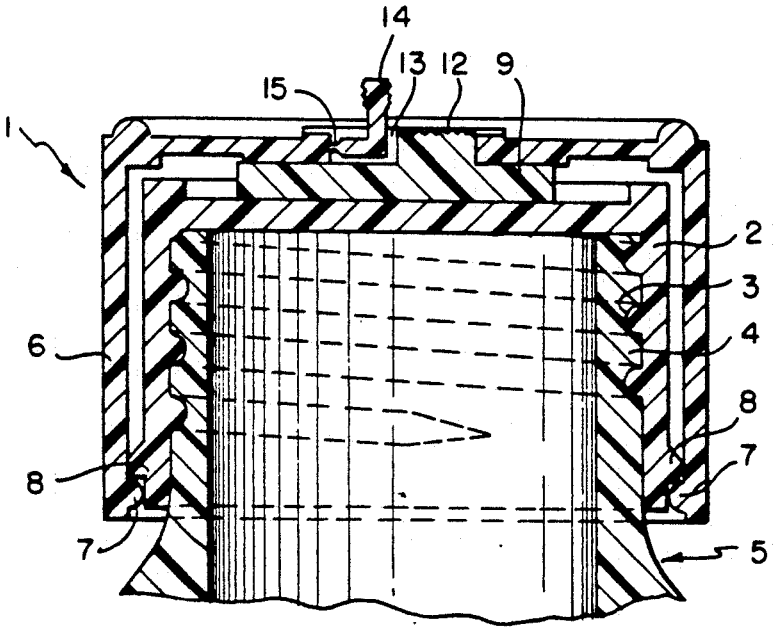

CHILD RESISTANT CLOSURE

BACKGROUND OF THE INVENTION

Various child resistant closures for medicine bottles have been devised to prevent or at least resist the access to the contents of the medicine bottle by children. One such closure includes an inner cap threadably mounted on the medicine bottle and an outer cap freely rotatable on the inner cap when an attempt is made to remove the closure from the bottle. Cam or latching arrangements are usually provided between the inner and outer caps, whereby they can be manipulated into a connected mode so that the closure can be removed from the bottle. The manipulation required is designed to be too difficult for a child to accomplish, thereby rendering the closure child resistant.

U.S. Pat. No. 2,772,803, dated Dec. 4, 1956, discloses a child resistant closure of the type noted above and which includes a latch slidably mounted between the top walls of the inner and outer caps.

U.S. Pat. No. 2,381,207 further discloses an indicator consisting of a colored spot on the top wall of the inner cap viewable through an aperture in the outer cap to indicate to the user that the latch components are aligned for manipulation. While these child resistant closures have been satisfactory for their intended purpose, after considerable research and experimentation, the child resistant closure of the present invention has been devised as an improvement on the prior art closures.

SUMMARY OF THE INVENTION

The child resistant closure of the present invention comprises, essentially, an inner cap having internal threads for engagement with threads on a container, and an outer cap freely rotatable on the inner cap. An upwardly extending colored post is provided on the top wall of the inner cap and is viewable through an aperture in the top wall of the outer cap, and a latch member is slidably mounted between the top walls of the inner and outer caps and engageable with the latch post, whereby the inner and outer caps are connected so that the inner and outer caps can be turned in unison for removal from the container. By this construction and arrangement, the colored post provides the dual function of a component in the latch assembly, and as an indicator for indicating to the user that the slidable latch member is in alignment with the latch post so that the latch assembly can be manually manipulated to connect the outer cap to the inner cap.

The top wall of the inner cap is formed with a cam surface engageable by the latch member when the outer cap is rotated to secure the closure to the container, whereby the latch member is automatically slid in a direction away from the latch post to a release position.

The top wall of the outer cap is also provided with a tamper evident tab to prevent the unauthorized manipulation of the latch member.

BRIEF DESCRIPTION OF THE DRAWINGS

FIG. 1 is a perspective view of the child resistant closure of the present invention;

FIG. 2 is a perspective view of the child resistant closure as shown in FIG. 1 but with the tamper evident tab removed therefrom;

FIG. 3 is a top plan view of the inner cap showing the latch member on the top wall thereof;

FIG. 4 is a view taken along line 4—4 of FIG. 3 with the latch member omitted therefrom;

FIG. 5 is a perspective view of the slidable latch member;

FIG. 6 is a top plan view of the child resistant closure;

FIG. 7 is a view taken along line 7—7 of FIG. 6;

DESCRIPTION OF THE PREFERRED EMBODIMENT

Figure 8:
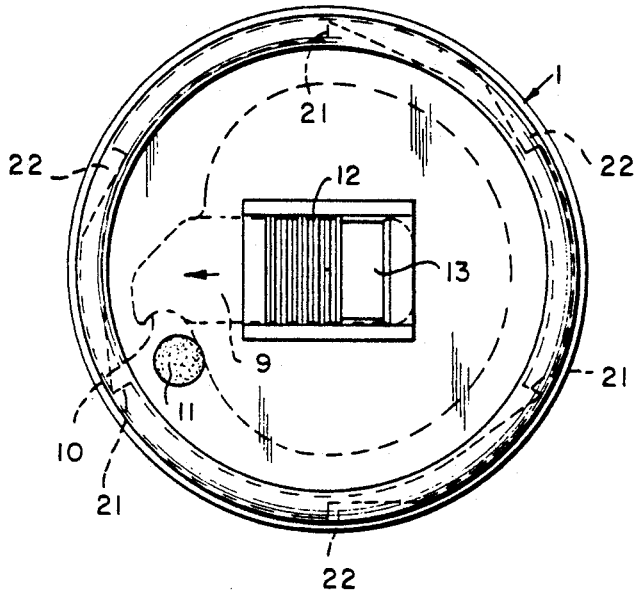
FIG. 8 is a top plan view of the closure showing the latch member being moved to a position to engage the latch post.

Referring to the drawings and more particularly to FIGS. 1, 3, 4 and 7, the child resistant closure 1 of the present invention comprises an inner cap 2 having internal threads 3 for engagement with threads 4 on the neck of a container 5. An outer cap 6 is captured on the inner cap 2 by a radially inwardly extending bead 7 formed on the bottom of the skirt portion on outer cap 6 engaging the lower surface of a radially outwardly extending flange 8 formed on the corresponding lower skirt portion on the inner cap 2, whereby the outer cap 6 is freely rotatable on the inner cap 2 when the closure is rotated in a counterclockwise direction in an attempt to remove the closure 1 from the container 5.

In order that the inner and outer caps can be interconnected for removal of the closure 1 from the container, a latch assembly is provided comprising a latch member 9 slidably mounted between the upper surface of the top wall of the inner cap 2 and the bottom surface of the top wall of the outer cap 6. The latch member 9 is provided with a hook portion 10, FIG. 5, on one end thereof adapted to engage a post 11 integral with the top wall of the inner cap 2 and extending upwardly therefrom. A thumb or finger engageable button portion 12 is integral with the latch member 9 and extends upwardly through an opening or window 13 provided in the top wall of the outer cap 6.

A tamper evident tab 14 is frangibly connected as at 15 to an edge of the window 13, whereby the movement of the latch member 9 into engagement with the post 11 is prevented by the tab 14 until it is torn from the window 13, as shown in FIG. 2.

Figure 9:
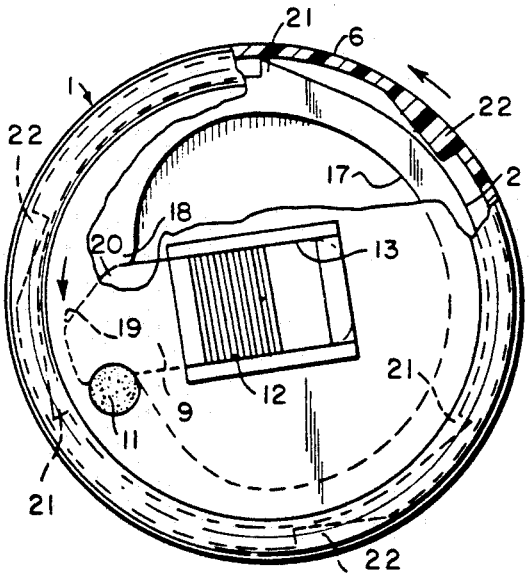
FIG. 9 is a top plan view of the closure, partly in section, showing the latch member engaging the latch post.

In order that the user will be aware that the hook portion 10 of the latch member 9 is aligned with the post 10 preparatory to sliding the latch member 9 into engagement with the post, the post is brightly colored and its end portion is visible through an aperture 16 provided in the top wall of the outer cap 6. FIGS. 8 and 9 illustrate the manipulation of the latch member 9 into engagement with the post 11 to interconnect the inner and outer caps 2 and 6 so that the closure 1 can be rotated in a counterclockwise direction to remove the closure 1 from the container 5.

Figure 10:
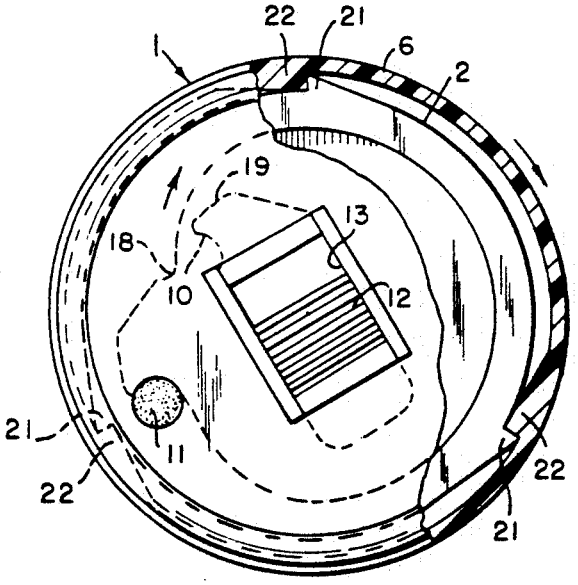
FIG. 10 is a top plan view of the closure, partly in section, showing the closure being threaded onto a container with the latch member being cammed inwardly to the released position.

As will be seen in FIGS. 3, 9 and 10, the top of the inner cap 2 is formed with a recess having a peripheral wall having and annular portion 17, a cam portion 18 and a portion 19 configured to conform to the nose portion 20 of the latch member 9. The recess peripheral wall is also provided with a plurality of circumferentially spaced radially outwardly extending teeth 21 adapted to engage correspondingly shaped, oppositely extending, circumferentially spaced teeth 22 formed integral with the inner surface of the skirt portion of the outer cap 6 in proximity to the top wall thereof, whereby when the closure 1 is rotated to secure the closure to the container, the outer cap 6 will first move a short distance independently of the inner cap 2 until the teeth 21 and 22 become engaged as shown in FIG. 10. Continued rotation of the closure 1 will result in the inner and outer caps 2 and 6 moving in unison onto the threaded neck of the container. During the initial clockwise rotation of the outer cap 6 relative to the inner cap 2, the latch member 9 will be carried by the outer cap 6 so that the nose portion 19 will engage the fixed cam portion 18 on the inner cap 2, resulting in the latch member 9 being slid inwardly away from the post 11 to a released position as shown in FIG. 10.

From the above description, it will be appreciated by those skilled in the art that the child resistant closure is an improvement over similar child resistant closures in that the post 11 provides a two-fold function; namely, an indicator to show when the latch assembly is in alignment for actuation, and as one of the components of the latch assembly. Furthermore, the camming action of the latch member 9 to the released position is accomplished automatically during the rotation of the outer cap 6, thereby precluding the necessity of manually engaging the latch member 9 to slide it to the released position.

The addition of the tamper-evident tab 14 also prevents the unauthorized manipulation of the latch member 9.

It is to be understood that the form of the invention herewith shown and described is to be taken as a preferred example of the same, and that various changes in the shape, size and arrangemet of parts may be resorted to, without departing from the spirit of the invention or scope of the subjoined claims.

I claim:

1. A child resistant closure for a medicine bottle comprising, an inner cap having internal threads for engagement with threads on the bottle, an outer cap freely rotatable on said inner cap, each of said caps having a top wall and a depending skirt portion, the top wall of said outer cap being spaced above the top wall of said inner cap, a latch member slidably mounted in the space between the top walls of said inner and outer caps, a post integral with the top wall of said inner cap and extending upwardly therefrom in said space, an aperture in the top wall of the outer cap alignable with a top surface of said post, whereby the position of the post can be observed to indicate alignment of the latch member with the post preparatory to sliding the latch member into engagement with the post to thereby interconnect the inner and outer caps, whereby the closure can be removed from the bottle.

2. A child resistant closure according to claim 1, wherein the post is brightly colored to facilitate observation thereof through said aperture.

3. A child resistant closure according to claim 1, wherein said latch member includes a hook portion for engaging the post.

4. A child resistant closure according to claim 1, wherein the top wall of said inner cap includes a recess having a peripheral wall, a cam portion provided on said peripheral wall engageable by said latch member upon initial rotation of the outer cap to secure the closure to the bottle, whereby the latch member is slid to a released position away from said post.

5. A child resistant closure according to claim 1, wherein a window is provided in the top wall of the outer cap, and a finger engaging button integral with said latch member extending through said window.

6. A child resistant closure according to claim 5, wherein a tamper evident tab is frangibly connected to an edge of said window adjacent said button, whereby movement of the latch member into engagement with the post is prevented until the tab is torn from the window edge.

7. A child resistant closure according to claim 4, wherein a plurality of circumferentially spaced radially outwardly extending teeth are provided on the peripheral wall of said recess on said inner cap, a plurality of circumferentially spaced radially inwardly extending teeth formed integral with the skirt portion of said outer cap in proximity to the top wall thereof and engageable with the teeth on the inner cap, whereby when the outer cap is initially rotated to secure the closure to the bottle, the outer cap moves a short distance relative to the inner cap until said teeth become engaged, whereupon the caps rotate in unison to thereby secure the closure to the bottle.

* * * * *